US011032637B2

(12) United States Patent
Wang

(10) Patent No.: US 11,032,637 B2
(45) Date of Patent: Jun. 8, 2021

(54) LOUDSPEAKER, MOBILE DEVICE, AND METHOD FOR ASSEMBLING LOUDSPEAKER

(71) Applicant: AAC Technologies Pte. Ltd., Singapore (SG)

(72) Inventor: Chengliang Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 59 days.

(21) Appl. No.: 16/699,757

(22) Filed: Dec. 2, 2019

(65) Prior Publication Data

US 2020/0213713 A1 Jul. 2, 2020

(30) Foreign Application Priority Data

Dec. 27, 2018 (CN) ..... 201811613758.7

(51) Int. Cl.

| | |
|---|---|
| ***H04R 25/00*** | (2006.01) |
| ***H04R 1/28*** | (2006.01) |
| ***H04R 31/00*** | (2006.01) |
| ***H04R 7/04*** | (2006.01) |
| ***H04R 7/18*** | (2006.01) |
| ***H04R 1/02*** | (2006.01) |

(52) U.S. Cl.

CPC ..... *H04R 1/288* (2013.01); *H04R 1/025* (2013.01); *H04R 7/04* (2013.01); *H04R 7/18* (2013.01); *H04R 31/006* (2013.01); *H04R 2400/11* (2013.01)

(58) Field of Classification Search

CPC .... H04R 1/025; H04R 1/288; H04R 2400/11; H04R 31/006; H04R 7/04; H04R 7/18; H04R 1/021; H04R 1/2803; H04R 2499/11; H04R 31/00; H04R 9/06

USPC ..... 381/354

See application file for complete search history.

(56) References Cited

U.S. PATENT DOCUMENTS

| | | | | |
|---|---|---|---|---|
| 9,883,266 | B2 * | 1/2018 | Dai | H04R 9/06 |
| 10,798,481 | B2 * | 10/2020 | Niu | H04R 1/023 |
| 2017/0208386 | A1 * | 7/2017 | Yang | H04R 9/06 |

* cited by examiner

*Primary Examiner* — Phylesha Dabney

(74) *Attorney, Agent, or Firm* — W&G Law Group LLP

(57) ABSTRACT

The invention provides a loudspeaker, including: a first cover plate; a second cover plate covering the first cover plate; a speaker unit assembled on the first cover plate; an assembly opening formed in the second cover plate; a packaging ring clamped and assembled in the assembly opening. The packaging ring surrounds the speaker unit. The loudspeaker further includes a a rear cavity, formed by the packaging ring, the first cover plate and the second cover plate, a sounding adsorbing material filled in the rear cavity, and a through hole formed in a periphery of the packaging ring for communicating the rear cavity with the speaker unit. The packaging ring includes a mesh plate disposed on the periphery of the packaging ring and covering the through hole.

8 Claims, 5 Drawing Sheets

LOUDSPEAKER, MOBILE DEVICE, AND METHOD FOR ASSEMBLING LOUDSPEAKER

FIELD OF THE PRESENT DISCLOSURE

The present disclosure relates to the field of electroacoustic transducers, more particularly to a loudspeaker used in a mobile device. The present disclosure further relates to a mobile device using the loudspeaker, and relates to a method for assembling the loudspeaker.

DESCRIPTION OF RELATED ART

A portable mobile device has become an essential part in life of people, and the sound playing function is an important part in portable device. In the rapid development process of the portable mobile device, a loudspeaker for playing sound is also continuously developed.

Generally, the loudspeaker comprises an upper cover, a speaker unit and a lower cover, wherein a surrounding wall is integrally arranged in the lower cover. An accommodation space is formed between the surrounding wall and the upper cover when the upper cover is assembled with the lower cover. The speaker unit is accommodated in the accommodation space. The upper cover, the lower cover and the speaker unit jointly define a rear cavity.

Compared with portable mobile devices with various structures, the existing loudspeaker is restricted by mold forming requirements during application, so that the cost is high, and the loudspeaker is not suitable for large-scale use.

Therefore, it is necessary to provide an improved loudspeaker to solve the problems mentioned above.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

Figure 1:
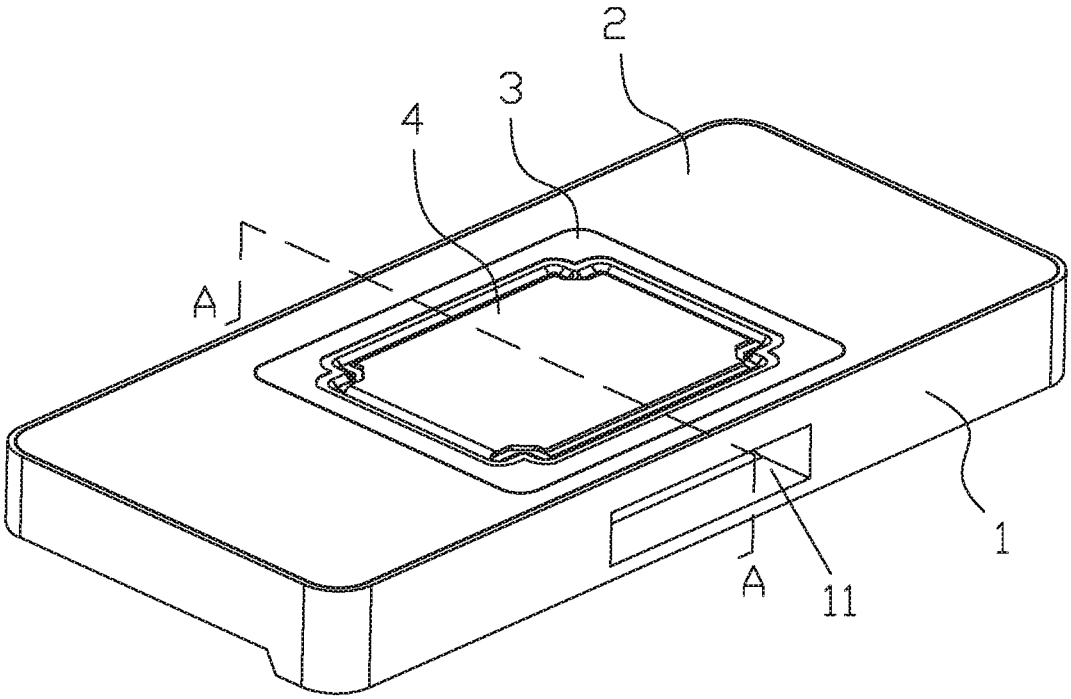
FIG. 1 is an isometric view of a loudspeaker in accordance with an exemplary embodiment of the present invention, from one aspect.

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

In an exemplary embodiment of the present disclosure, as shown in FIGS. 1-5, a mobile device comprises a loudspeaker. The loudspeaker comprises a first cover plate 1, a second cover plate 2, a packaging ring 3 and a speaker unit

4. The speaker unit 4 is assembled on the first cover plate 1. The second cover plate 2 covers the first cover plate 1, and an assembling opening 21 is formed in the second cover plate 2. The packaging ring 3 is clamped and assembled in the assembling opening 21. The packaging ring 3 is arranged and surrounds the speaker unit 4. The packaging ring 3, the first cover plate 1 and the second cover plate 2 jointly define a rear cavity, in which a sound absorbing material (SAM) material is filled. The rear cavity is bounded by the speaker unit 4. A through hole 31 is formed in a periphery of the packaging ring 3 for communicating the back cavity with the speaker unit 4. The packaging ring 3 further comprises a mesh plate 33 arranged on a circumferential wall of the packaging ring 3 and covers the through hole 31.

The loudspeaker unit 4 is assembled on the first cover plate 1, he second cover plate 2 is assembled above the first cover plate 1, and then the packaging ring 3 is assembled in the assembling opening 21 of the second cover plate 2, such that, the packaging ring 3 is arranged outside the speaker unit 4. The first cover plate 1, the second cover plate 2 and the packaging ring 3 are enclosed to form the rear cavity. The rear cavity and the speaker unit 4 are communicated with each other through the through hole 31 formed in the periphery of the packaging ring 3. The mesh plate 33 is used for preventing the SAM material from entering the speaker unit 4 from the rear cavity, so that the speaker unit 4 is protected from the SAM material. The loudspeaker is not restricted by the mold forming requirement, and is convenient for large-scale application with low cost.

Figure 2:
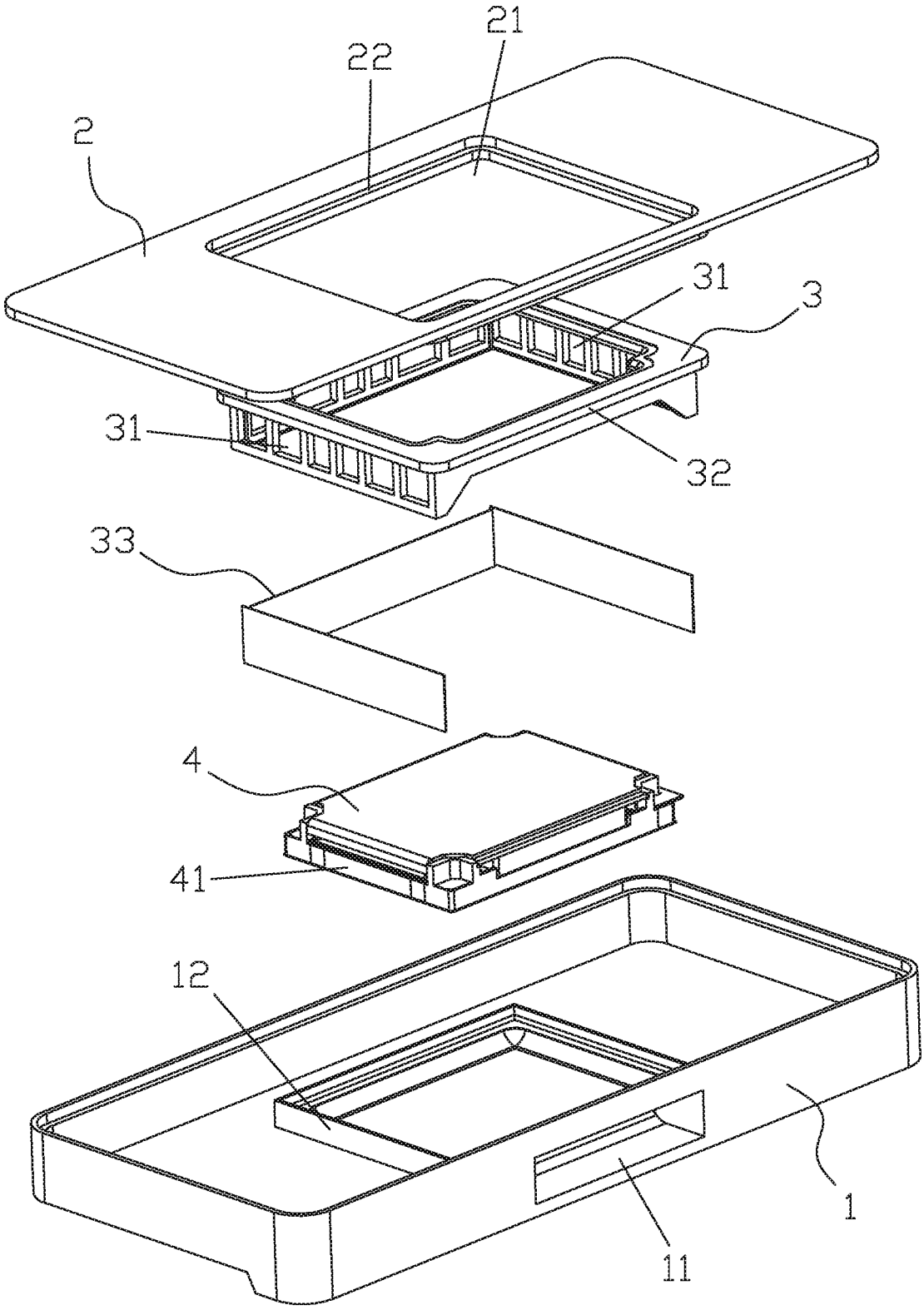
FIG. 2 is an exploded view of the loudspeaker in FIG. 1.
Figure 3:
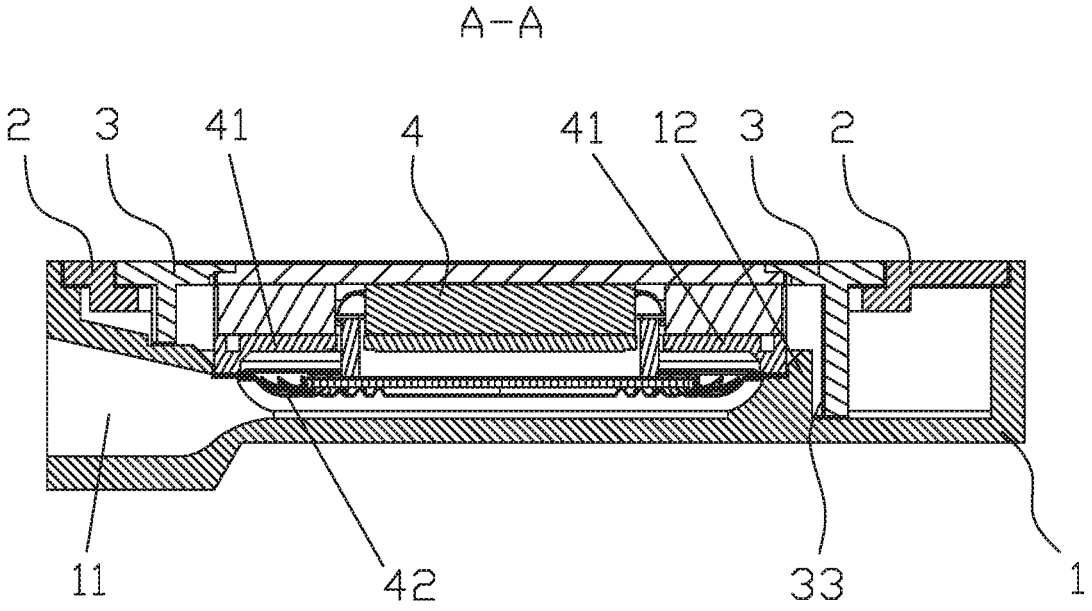
FIG. 3 is a cross-sectional view of the loudspeaker, taken along line A-A in FIG. 1.
Figure 4:
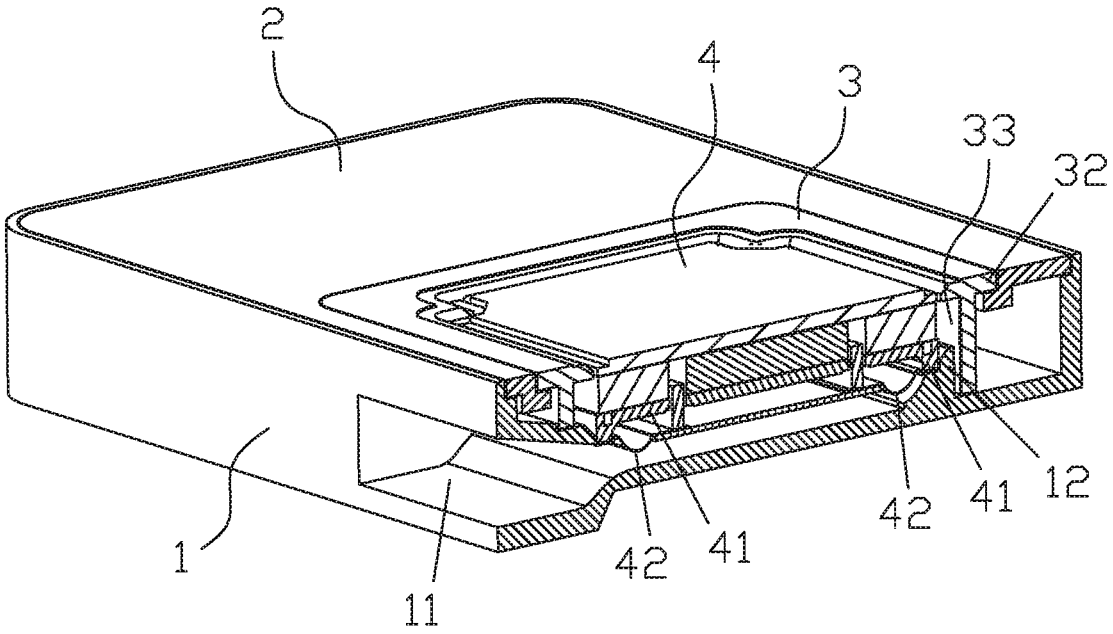
FIG. 4 is an isometric and broken view of the loudspeaker.
Figure 5:
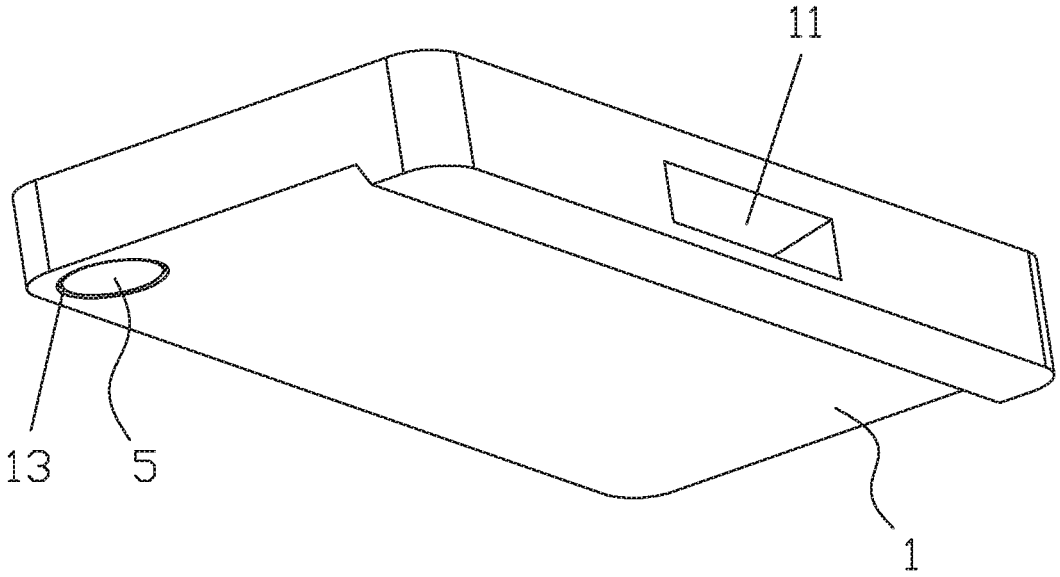
FIG. 5 is an isometric view of the loudspeaker, from another aspect.

Specifically, as shown in FIGS. 2-4, in the embodiment, the first cover plate 1 has an outer wall, and an end surface of the outer wall is provided with a clamping groove. The second cover plate 2 is embedded in the clamping groove of the outer wall. The outer wall of the second cover plate 2 and the outer wall of the first cover plate 1 are fixed through ultrasonic welding process.

A groove 22 is formed in an edge of the second cover plate 2 located at the assembling opening 21, while, the edge of the top side of the packaging ring 3 is provided with a flange 32 extending outwards. When the packaging ring 3 is assembled in the assembling opening 21, the flange 32 is clamped and fixed in the groove 22 of the second cover plate 2. The top surface of the packaging ring 3 and the top surface of the speaker unit 4 are coplanar with the top surface of the second cover plate 2.

The first cover plate 1 is provided with a packing hole 13 used for filling the SAM material into the rear cavity. Further, the packing hole 13 is provided with a sealing cover 5 matched with the packing hole 13. In the embodiment, the SAM material is in the form of granular. The SAM material is filled into the rear cavity via the packing hole 13 and then sealed by the sealing cover 5. The SAM material is filled in the rear cavity, so that the low-frequency sounding performance of the loudspeaker is accordingly improved.

The speaker unit 4 further has a frame 41 and a diaphragm 42. The first cover plate 1 is provided with a sound outlet hole 11. The clamping wall 12 surrounding the sound outlet hole 11 is arranged in the first cover plate 1. A limiting structure is arranged in the clamping wall 12. The frame 41 is assembled in the clamping wall 12 and abuts against the limiting structure. The frame 41, the diaphragm 42, the clamping wall 12 and the first cover plate 1 are enclosed to form a front cavity for communicating with the sound outlet hole 11.

In the embodiment, the packaging ring 3 surrounds the clamping wall 12, and a notch is formed in one side of the peripheral wall of the packaging ring 3. The notch is matched with the clamping wall 12 at the sound outlet hole 11. Therefore, the end surface of the circumferential wall of the packaging ring 3 is tightly attached to the first cover. A jointing position between the packaging ring 3 and the lower cover plate is fixed by glue. A plurality of through holes 31 is formed in the other three sides of the peripheral wall of the packaging ring 3. The mesh plate 33 is attached to the other three sides of the peripheral wall of the packaging ring 3. Further, the mesh plate 33 is attached to the inner wall of the packaging ring 3 and covers the through hole 31. The mesh plate 33 and the peripheral wall of the packaging ring 3 are connected integrally through injection molding, glue bonding or hot melting. The filling effect of the SAM material is effectively increased, so that the acoustic performance of the loudspeaker is improved. Optionally, the mesh plate 33 can be attached to the outer side of the peripheral wall of the packaging ring 3 by injection molding, glue bonding or hot melting.

The present disclosure further provides a method for assembling the loudspeaker described above. The method comprises the following steps:

S1, assembling the loudspeaker unit 4 on the first cover plate 1; specifically, in the embodiment, the loudspeaker unit 4 is assembled in the clamping wall 12, the outer side surface of the frame 41 abuts against the inner side surface of the clamping wall 12, and the bottom surface of the frame 41 abuts against the limiting structure in the clamping wall 12, so that a front cavity space is formed between the vibrating diaphragm 42 and the first cover plate 1;

S2: covering and fixing the second cover plate 2 on the first cover plate 1. Wherein, the second cover plate 2 covers the clamping groove in the outer wall of the first cover plate 1, and then fixes the second cover plate 2 and the outer wall of the first cover plate 1 by ultrasonic welding. Optionally, the second cover plate 2 and the first cover plate 1 can also be fixed by screws, adhesives or clamping connection;

S3: arranging the packaging ring 3 surrounding the speaker unit 4 from the assembling opening 21, wherein a rear cavity is defined by the packaging ring 3, the second cover plate 2 and the first cover plate 1. The circumferential wall of the packaging ring 3 is pressed into the assembling opening 21, so that the end surface of the circumferential wall of the packaging ring 3 is in contact with the first cover plate 1. The flange 32 is clamped in the groove 22, and the packaging ring 3 is tightly connected with the first cover plate 1 and the second cover plate 2 after the glue is dried;

S4: filling an SAM material into the rear cavity. In detail, the SAM material is in the form of granule, and is filled into the rear cavity via the packing opening in the first cover plate 1. Seal the sealing cover 5 after the SAM material is fully filled in the rear cavity.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A loudspeaker, comprising:

a first cover plate;

a second cover plate covering the first cover plate;

a speaker unit assembled on the first cover plate;

an assembly opening formed in the second cover plate;

a packaging ring clamped and assembled in the assembly opening; the packaging ring surrounding the speaker unit;

a rear cavity, formed by the packaging ring, the first cover plate and the second cover plate, bounding by the speaker unit;

a sounding adsorbing material filled in the rear cavity;

a through hole formed in a periphery of the packaging ring for communicating the rear cavity with the speaker unit; wherein the packaging ring comprises a mesh plate disposed on the periphery of the packaging ring and covering the through hole.

2. The loudspeaker as described in claim 1 further including a groove formed in an edge of the assembling opening of the second cover plate and a flange disposed at a top side of the packaging ring, wherein when the packaging ring is assembled in the assembling opening, the flange is clamped in the groove.

3. The loudspeaker as described in claim 1 further including a packing hole formed in the first cover plate, and a sealing cover engaging with the packing hole.

4. The loudspeaker as described in claim 1, wherein the speaker unit includes a frame, a diaphragm assembled with the frame, a sound outlet hole formed in the first cover plate, a clamping wall surrounding the sound outlet hole disposed on the first cover plate; the frame is assembled with the clamping wall; the frame, the diaphragm, the clamping wall and the first cover plate are enclosed to form a front cavity communicating with the sound outlet hole.

5. The loudspeaker as described in claim 4, wherein the packaging ring includes a notch at one side of a circumferential wall thereof; the notch is matched with the clamping wall of the sound outlet hole; a plurality of through holes is formed in other side of the circumferential wall of the packaging ring; a mesh plate is attached to the other sides of the peripheral wall of the packaging ring; further, the screen plate is attached to an inner wall of the packaging ring.

6. The loudspeaker as described in claim 4, wherein the packaging ring includes a notch at one side of a circumferential wall thereof; the notch is matched with the clamping wall of the sound outlet hole; a plurality of through holes is formed in other side of the circumferential wall of the packaging ring; a mesh plate is attached to the other sides of the peripheral wall of the packaging ring; further, the screen plate is attached to an outer wall of the packaging ring.

7. A mobile device comprising a loudspeaker as described in claim 1.

8. A method for assembling a loudspeaker as described in claim 1, wherein the method includes steps of:

assembling a speaker unit on a first cover plate;

covering and fixing a second cover plate on the first cover plate;

providing a packaging ring surrounding the speaker unit through an assembling opening, and a rear cavity formed by the packaging ring, the second cover plate and the first cover plate;

filling a sounding adsorption material into the rear cavity.

* * * * *